US006923697B1

(12) United States Patent
Wagner

(10) Patent No.: US 6,923,697 B1
(45) Date of Patent: Aug. 2, 2005

(54) UNIVERSAL OPEN-HEEL DIVE FIN REPLACEMENT HEEL STRAP

(76) Inventor: John L. Wagner, 4356 Panorama Dr., La Meas, CA (US) 91941

( * ) Notice: Subject to any disclaimer, the term of this patent is extended or adjusted under 35 U.S.C. 154(b) by 17 days.

(21) Appl. No.: 10/942,193

(22) Filed: Sep. 16, 2004

Related U.S. Application Data

(63) Continuation-in-part of application No. 10/176,297, filed on Jun. 18, 2002, now abandoned.

(51) Int. Cl.[7] ..... A63B 31/08
(52) U.S. Cl. ..... 441/64; 36/58.6
(58) Field of Search ..... 441/60, 61, 62, 441/63, 64; 36/11.5, 58.6, 105; D21/806; 24/68 SK; 2/428, 430, 452

(56) References Cited

U.S. PATENT DOCUMENTS

| | | | |
|---|---|---|---|
| 4,795,385 | A | 1/1989 | Matsuoka |
| 5,020,191 | A | 6/1991 | Uke |
| 5,545,067 | A | 8/1996 | Garofalo |
| 5,597,336 | A | 1/1997 | Evans |
| 5,607,334 | A | 3/1997 | Garofalo |
| 5,683,279 | A | 11/1997 | Raasch et al. |
| 5,960,565 | A | 10/1999 | Lochbaum |
| 6,227,924 | B1 | 5/2001 | Miller |
| 6,247,983 | B1 | 6/2001 | Yeh |
| 6,341,383 | B1 | 1/2002 | Beltrani |
| 6,398,604 | B1 | 6/2002 | Kawashima et al. |
| 6,435,926 | B1 | 8/2002 | Yeh |

FOREIGN PATENT DOCUMENTS

| | | |
|---|---|---|
| FR | 1241394 | 8/1960 |
| GB | 762126 | 11/1956 |

OTHER PUBLICATIONS

Calzuros® protective footwear; Steeles.com catalog at "www.steeles.com/catalog/calzuro.html".

*Primary Examiner*—Andrew D. Wright
(74) *Attorney, Agent, or Firm*—Frank G. Morkunas

(57) ABSTRACT

A dive fin replacement heel strap for use on open-foot pocket dive fins having a mounting device on each side of the fin to secure the fins onto a user's foot. The strap is made of an elongate elastic material and has a predetermined width (W). It has a plurality of orifices of a predetermined opening size (D), positioned on the elongate elastic material. There is a tab on the end of the elongate elastic material. The tab has a solid flexible lip around its periphery which has a width greater than W and a height greater than D. There is an indent in the upper horizontal surface and in the lower horizontal surface of the elongate elastic material adjacent to the tab. The orifices are adapted to attached to a mounting device of a dive fin. The tab is adapted to pass through a mounting device of a dive fin and to pass through an orifice and lock in place thereat.

12 Claims, 5 Drawing Sheets

UNIVERSAL OPEN-HEEL DIVE FIN REPLACEMENT HEEL STRAP

CROSS-REFERENCE TO RELATED APPLICATIONS

This application is a continuation-in-part of my application, application Ser. No. 10/176,297 filed on Jun. 18, 2002, now abandoned.

STATEMENT REGARDING FEDERALLY-SPONSORED RESEARCH OR DEVELOPMENT

None.

FIELD OF THE INVENTION

This invention relates to a new and improved universal dive fin replacement heel strap that can be used as a replacement strap on most conventional dive fins having an open foot pocket and knobs, metal pins, or female buckling system protruding from the outer sides as a means of attachment. More particularly, the invention relates to a simple, adjustable, economical heel strap that has no buckling mechanisms, and may be kept in reserve for the occasion when the straps or buckles that are supplied with the dive fins need to be replaced. This new and unique universal dive fin heel strap could be supplied separately in many bright colors or featured on new dive fins.

BACKGROUND OF THE INVENTION

Swimming has developed far beyond just a recreational sport, expanding into various occupational and military activities. This development has created a need for improvements in the devices used in the act of swimming, with the swim fin being one of the major component advancements. Swim fins increase a swimmers capability greatly on the surface, and are a necessity in the act of deep diving using open-heel dive fins.

There are three basic styles of fins, the full foot pocket style forming a shoe-like [generally pre-formed] foot pocket and the fixed-heel strap style, both having a variety of propulsion blades with the heel strap, or pre-formed foot pocket, as an integral part. These styles of fins have a fixed-heel strap [or pre-formed foot pocket], and must be purchased to the size of the foot of the individual that will be using them. With this style of fin the distributors must carry a large variety of sizes along with the different styles. The full foot style of fin must be discarded when one of the heel straps break.

The third style of fins referred to, as open heel or strap fin is adjustable to the individual using them by the means of the heel strap usually incorporating a buckle adjustment mechanism. This style of fin also has a variety of styles of propulsion blades. Adjustments in size are most commonly accomplished by the means of a buckle on one or both sides of the open heel pocket. The majority of fins of this style have a heel strap mounting knob with an enlarged head and a shank member affixed on the outer surface of either side of the foot pocket as an integral part of the fin. The heel straps are attached to these knobs by different means of attachment that generally incorporate the buckling mechanisms for adjustment, so the heel straps can be replaced if they break or no longer will tighten properly or are inadvertently lost, which is most common at the beach. Often these straps and buckles are expensive and hard to find with most distributors preferring to sell a new pair of fins, and swimmers not having the convenience of carrying a spare set of straps for their fins. The open heel or strap style of fin is most commonly used when the swimmer wants the option of wearing or not wearing the protective booties in cold water requiring the adjustment of the fin size. Another difficulty presented by the straps after a period of time is the metal buckles will cut the rubber straps at the gripping area or the metal buckles will chafe the ankles of the swimmer; or the plastic buckles can be broken or lost.

Several inventors have endeavored to patent new and improved heel straps for the open heel or strap style of fins but most are complicated adding to their expense, time it takes to effect a replacement, and generally retaining some form of buckling mechanism.

U.S. Pat. No. 5,545,067 of Giovanni Garofalo relates to swimming fins, especially the open-shoe type of swimming fin with a heel strap secured to both sides of the foot pocket, and relates more particularly to a buckle for adjustably fastening the strap to the fin. This patent typifies the conventional style of fins using the strap and buckle system. This device does not incorporate any of the unique features of the universal fin replacement heel strap, but concentrates on the leverage features of the metal buckling system.

U.S. Pat. No. 5,597,336 of Robert B. Evans describes a uniquely configured fin having an open instep that is secured to the foot of the wearer by a padded securement means so as to accommodate a plurality of foot sizes. The heel strap consists of an elastic loop through a heel cushion secured to the fin by the means of a bracket. This patent dwells primarily with the unique open instep concept and the fact that the fins may be manufactured from a two-piece molding system. The heel straps, though similar do not make use of the knobs found on the most common fins and has no intention of being a universal fin replacement heel strap and in particular for open-heel dive fins.

U.S. Pat. No. 5,607,334 of Giovanni Garofalo teaches of a swim fin equipped with a buckle for the fastening of the heel strap. The heel strap of this swim fin attaches in a similar fashion with a buckle for length adjustments to the conventional fin knobs on the sides of the foot pockets, except that this heel strap has the unique limited rotation feature requiring a radial tooth which cooperates with an abutment element on the knob to prevent the downward rotation.

U.S. Pat. No. 6,247,983 of Tzong In Yeh discloses an adjusting strap structure for swim fins. Although this strap structure does not incorporate a buckling system, it is designed for a specific type of swim fins, and will not fit other manufacturers swim fins in that it does not make use of the knobs on the sides of most common swim fins.

U.S. Pat. No. 6,227,924 of Phillip W. Miller describes a heel strap for an open heel swim fin designed to securely hold the user's foot in the swim fin, yet minimize ankle and foot movement within the heel straps. The heel strap comprises a heel pocket and set of straps with buckles to attach to the swim fins. This device makes use of a locking receptacle or buckle to attach the heel strap to the sides of the foot pocket.

U.S. Pat. No. 6,341,383 of Giovanni Battista Beltrani teaches of an adjustable back strap for diving and swimming equipment. Although this patent makes use of the conventional knobs and buckling attachment mechanism, it could possibly be seen as a universal swim fin strap, but it would be difficult to store a spare set because it is comprise of several types of buckling systems along with a complicated heel supporting structure.

In addition, other prior-art patents to Uke [U.S. Pat. No. 5,020,191], Raasch [U.S. Pat. No. 5,683,279], Lochbaum [U.S. Pat. No. 5,960,565], Kawashima [U.S. Pat. No. 6,398,604], and to Clark [GB 762,126], although solving other problems unique to swim fins, none are specifically directed to the open-heel dive fin. Moreover, none of the prior-art patents disclose the unique features and function of the present invention for use with open-heel dive fins which features permit the diver to continue a dive by using the tab ends of the present invention to attach the strap to the dive fin by inserting the tabbed ends through an orifice on the strap and to hold it or to tie it in place thereat. The present invention accordingly comprises the features of construction, combination of elements, and arrangement of parts that will be exemplified in the construction hereinafter set forth, and the scope of the invention will be indicated in the claims.

SUMMARY OF THE INVENTION

The present invention accomplishes its desired objects by creating a device that can be manufactured easily as a single elastic unit with no additional parts and can be vacuum-wrapped on small display cards. The manufacturing materials may be of an elastromeric rubbers or a variety of thermo-plastic elastomers, urethanes, or other flexible rubber-like materials, and will conform to a variety of conventional forms of manufacturing, like injection molding and casting processes. With the size and simplicity of this product it can be manufactured in many bright and striking colors to add an additional component to its unique features.

The simplicity of this unique device is accomplished by several features that allow the universal replacement dive fin strap to be attached to a variety of different styles of dive fins by the means of a plurality of orifices on either side of the heel area extending to both distal ends of the strap. These orifices may be in a number of different geometric shapes, rectangular, spherical, elliptical or triangular. These orifices with their predetermined shape stretch over the existing heel strap mounting knobs enlarged head, located on the shank portion on each side of the conventional dive fins or its foot pocket.

These universal replacement dive fin straps will come in varying lengths with each strap accommodating a number of different sizes of feet. The elastic ability of the universal replacement dive fin strap allows it to fit comfortably on the wearer no matter what size their foot is, in a similar fashion to the fixed-heel strap style of fins. The universal replacement dive fin strap will have an enlarged heel area with a textured non-slip surface next to the heel of the wearer. The heel area may be flat with a pull tab, may have the pull tab angled away from the heel or may have a ring shaped pull to assist putting on the dive fins. The heel area may also have a curved shape matching the shape of the heel of the wearer, all while remaining within the scope of this patent.

Similar pull-tabs or pull rings are located at the distal ends of each side of the universal replacement dive fin strap to aide in the mounting of the straps over the knob heads on the sides of the dive fins and to facilitate grasping and pulling the strap over and onto a receiving knob on the fin or to pass the tab-lip through an orifice in the strap and, once so passed through, the tab-lip structure prevents the end of the strap from passing back out. The T-like configuration secures or "locks" itself in the orifice and may be removed by pinching or bending the tab-lip structure and easing it out of the orifice.

The ends of the straps of Lochbaum, Yeh, Steele, Clark, and Uke [which related to snorkels] are completely different in structure and function from that of applicant's strap and further are incapable of being firmly grabbed and, as tension mounts from pulling, are incapable of aiding the user in maintaining the user's grip on the end. Each end of these prior-art straps, except for Clark and Uke, are flat and provide no structural assistance to the user when so pulling. The lip of Clark is rather a bead outline the entire outer perimeter of the strap, and the strap of Uke is not analogous to this crowded art field. Moreover, the ends of all the prior-art straps are not adapted to pass through an orifice in the strap and secure itself thereat. Only applicant's strap has the structure and features for this purpose.

This feature, the tab and lip structure of the present invention, to pass through and 'lock' or secure into any given orifice on the strap has two additional useful purposes. One is to tuck away the loose end of the strap into a suitable orifice so that the loose end does not dangle or interfere with and possibly endanger one's dive by snagging or catching on an external object underwater. The other is to use this strap on any other type of fin which may have vertical posts or metal pins for strap connection. In this regard, both ends of the present invention may be looped with the tab-lip structure then inserted into and through any suitable orifice on the strap. The tab-lip structure "locks" itself once through that orifice and maintains a secure loop-like end which may be placed over the exposed post. The tension of the strap engaged over the posts and the heel of the user keeps the fins to which attached on the user's foot.

An alternate embodiment will incorporate an enlarged edge on both sides of the universal replacement dive fin strap, increasing the strength of the strap while still allowing the thinner wall of the central web area to stretch over the knob heads on the sides of the dive fins. This embodiment will incorporate the same arrangement of pull-tabs and heel configurations and still remain within the scope of this patent.

Another alternate embodiment of the universal replacement dive fin strap will incorporate a bungee cord forming loops to go over the heads of the heel strap mounting knobs on the sides of conventional dive fins. Each loop will have a retainer to maintain the size of the loop end of the bungee cord. There will also be a commercially available sliding adjustment device to vary the length of the bungee cord for size adjustments.

An additional alternate embodiment of the universal replacement dive fin strap will be comprised of plastic attachment clips and one or more sections of surgical tubing. The plastic attachment clips have an orifice with an enlarged end that fits over the heel strap mounting knob head on the sides of the dive fins and a reduced end that fits snugly on the shank section of the knobs when the fins are put on. These attachment clips have one or more prong ends allowing that when surgical tubing is slid over it will hold securely when a force is exerted to remove it. The surgical tubing will have to be cut to the size of the wearer, and can easily be replaced when it loses its elasticity or is broken.

The universal replacement dive fin strap and the additional embodiments endeavor to eliminate the use of the common buckling system of length adjustment and to create a device in its most simple state, along with the convenience of being able to always have a spare set whether they came on the dive fins or not.

Several objects of this invention include, but are not limited to:

a. Supply the market with simple, inexpensive universal replacement dive fin straps.
b. Create a single universal replacement dive fin strap that can fit on either the right or left fin, not requiring a right foot and left foot fin strap.
c. Create a dive fin strap that is small and light weight enough that divers can always carry a spare set with them so when a strap is either lost or broken there is no problem replacing it.
d. Create a dive fin strap that mounts easily to many different manufacturers dive fins by the means of the conventional heel strap mounting knobs.
e. Create a dive fin strap that does not have the conventional buckle as a means of adjustment.
d. Create a dive fin strap that can easily be made in many bright and varying colors.
e. Create a dive fin strap that has superior flexibility for holding the strap in position on the heel of the divers foot.
f. Create a dive fin strap that makes the open heal or strap style of dive fins perform in the same manner as a fixed-heel strap style of fin with the molded integral heel strap
g. Create a dive fin strap that allows a diver to use the same pair of dive fins whether they use the booties for cold water or not.
h. Provide a quick and easy replacement for a broken dive-fin strap while a diver is on a dive without requiring the diver to interrupt the dive and surface for a new dive fin.
i. Provide for a functionality of the end tab to facilitate a "locking" of itself into place into an orifice on the strap to hold the fin onto the strap.
j. Create a universal replacement dive fin strap that can be used as a replacement on a wide variety of styles and sizes of dive fins made by many different dive fin manufactures.

The present invention accomplishes its desired objects by providing a new and unique universal dive fin replacement strap that will fit a variety of different manufacturers dive fins, has no buckles, is adjustable and easily attached and made in a variety of colors. These together with other-objects and advantages which will become subsequently apparent reside in the details of the construction and operation as more fully hereinafter described and claimed, reference being had to the accompanying drawings forming a part hereof, wherein like numerals refer to like parts throughout

BRIEF DESCRIPTION OF THE DRAWING FIGURES

The accompanying drawings, which are incorporated in and form a part of this specification, illustrate embodiments of the invention and together with the description, serve to explain the principals of the invention.

DETAILED DESCRIPTION OF THE PREFERRED EMBODIMENTS

Figure 1:
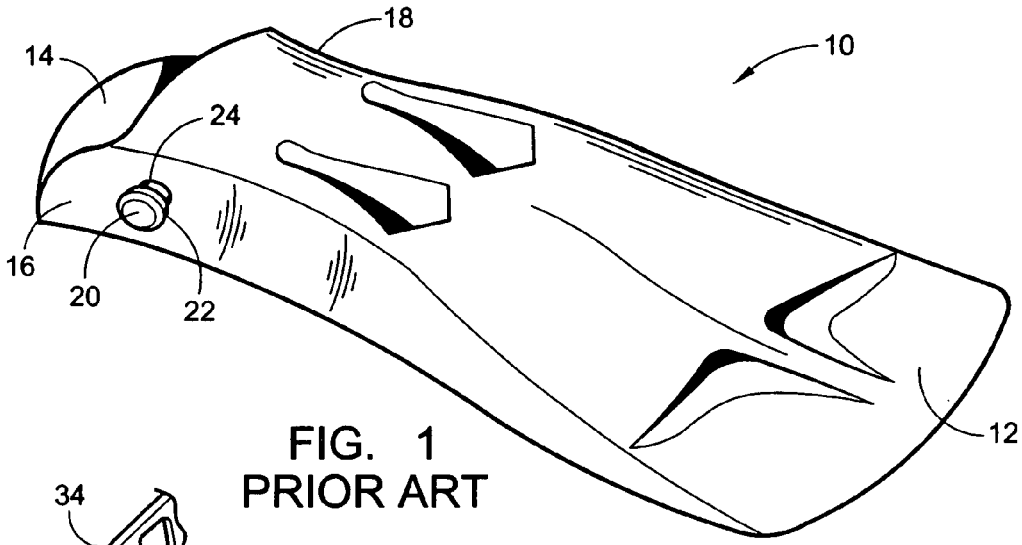
FIG. 1 PRIOR ART
FIG. 1 depicts a perspective view of a conventional prior-art open heel or strap style of dive fin.
Figure 2B:
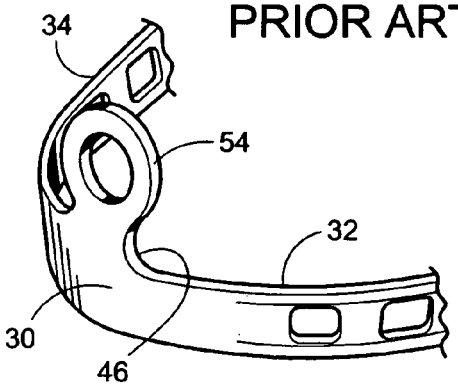
FIG. 2B depicts a perspective detailed view of the alternate embodiment of the pull-tabs as a ring grip, of the dive fin replacement heel strap.
Figure 2A:
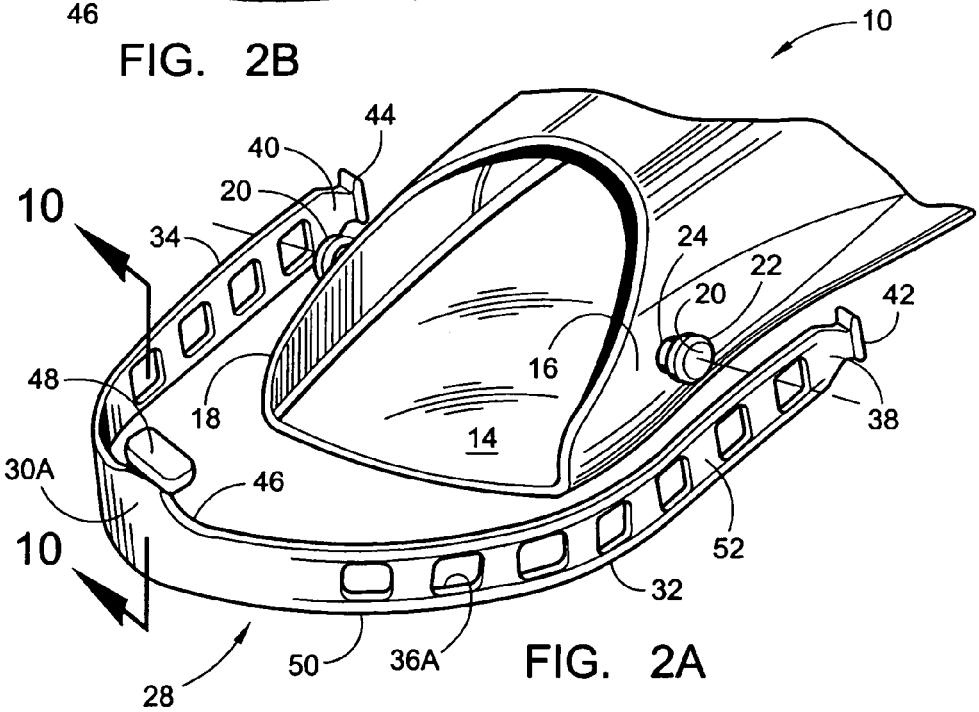
FIG. 2A depicts perspective view of the open heel portion of the conventional open heel or strap style dive fin with the preferred embodiment of the dive fin replacement heel strap exploded away.

Referring in detail now to the drawing, wherein similar parts of the invention are identified by like reference numerals, there is seen in FIG. 1 a perspective view of the conventional open heel or strap style of dive fin 10. At one end is the propulsion blade 12 that has many different configurations depending upon the manufacturer. At the opposite end 16 is the open foot pocket 14, distinguishing this style of dive fin from the full foot pocket style with the heel strap as an integral part of the fin. On the outer sides of the foot pocket 14 are the conventional heel strap mounting knobs 20 consisting of an enlarged head end 22 and a shank portion 24 used by several manufacturers of dive fins. FIG. 2A depicts a perspective view of the open foot pocket 14 of the open heel or strap style dive fin 10 with the universal replacement dive fin strap 28 exploded away. The universal replacement dive fin strap 28 consists of the heel area 30A with the side elements 32 and 34 and a plurality of orifices 36A in the rectangular shape, terminating at the distal ends 38 and 40 with pull-tabs 42 and 44. The surface of the heel area 30A will have a textured surface 46 to minimize sliding on the heel of the wearer. Additionally a similar pull-tab 48 is located centrally above the heel area 30A. The outer edges 50 of the universal replacement dive fin strap 28 may be enlarged on some embodiments with the central web 52 being a thinner section allowing the stretch required to expand over the heel strap mounting knobs 20. FIG. 2B depicts an alternate embodiment of the pull-tab 48 as being a ring grip 54 that can also replace the pull-tabs 42 and 44 at the distal ends of the side elements 32 and 34.

Figure 3:
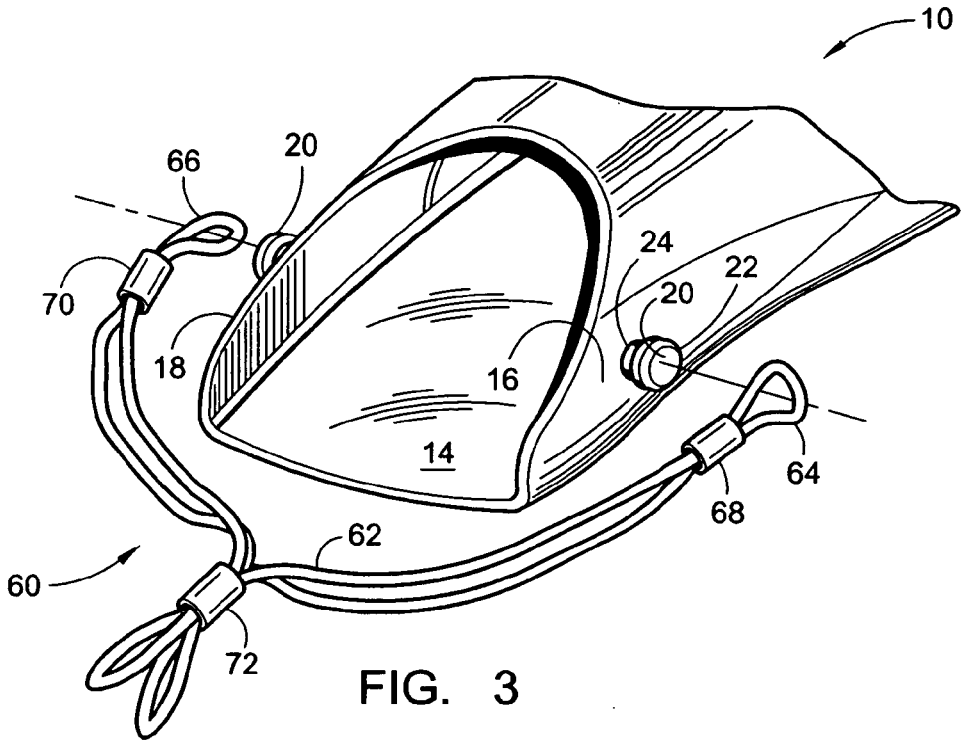
FIG. 3 depicts a perspective view of the open heel portion of the conventional open heel or strap style dive fin with alternate embodiment as a bungee cord style of dive fin replacement heel strap.

FIG. 3 depicts the open heel portion 14 of the open heel of strap style dive fin 10 with an alternate embodiment as a bungee cord style of dive fin replacement strap 60, consisting of a bungee cord 62 with loop ends 64 and 66. Loop ends 64 and 66 are held in position by retainers 68 and 70 while a sliding adjustment device 72 allows for length adjustments. The loop ends 64 and 66 expand to go over the enlarged head 22 of the heel strap mounting knobs 20 and tighten on the shank portion 24 in a similar fashion to the way that the orifices 36A through 36H work on the shank portion 24; or just orifices 36A, 36B, 36C, and 36D work on the shank portion 24.

Figure 4:
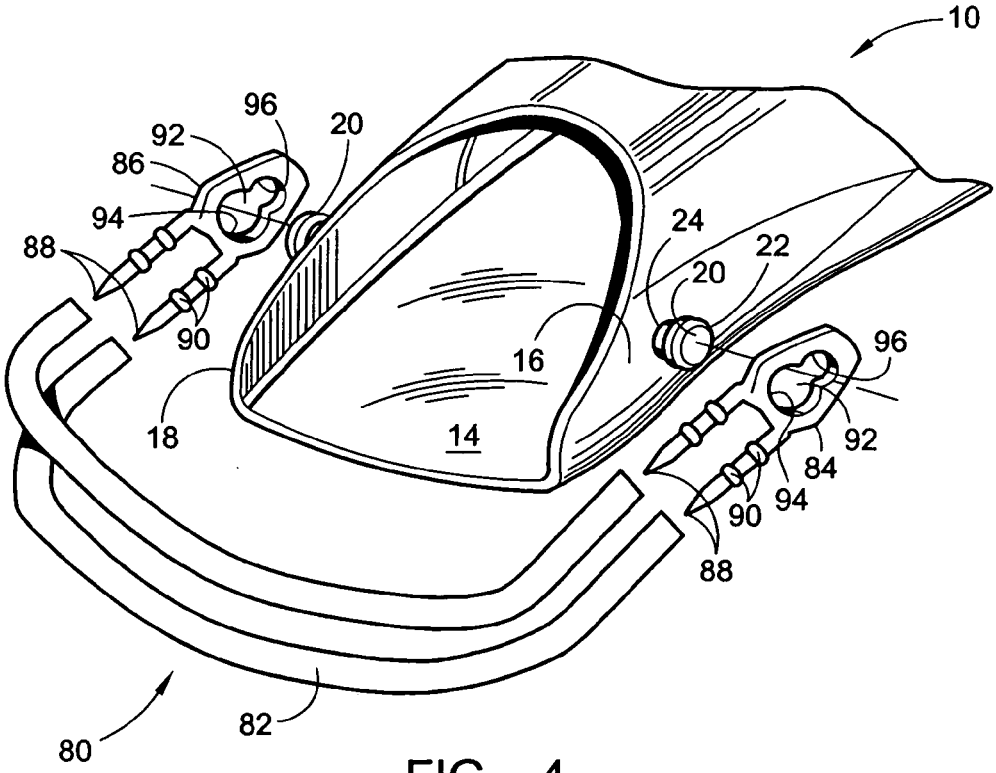
FIG. 4 depicts a perspective view of the open heel portion of the conventional open heel or strap style dive fin with another alternate embodiment as a surgical tubing style of dive fin replacement heel strap.

FIG. 4 depicts the open heel portion 14 of the open heel of strap style dive fin 10 with an additional alternate embodiment as surgical tubing style of dive fin replacement strap 80 composed of one or more sections of surgical tubing 82 connected to attachment clips 84 and 86. The surgical tubing 82 is connected to the attachment clips 84 and 86 by the conventional means of sliding the tubing over the prong end 88 and over the retainer bumps 90. When the surgical tubing is pushed on the prong ends 88, it expands allowing it to slide easily over the bumps 90, but when a force is applied to remove the tubing, it shrinks and holds tightly to the bumps 90 on the prong ends 88. The attachment clips 84 and 86 have an orifice 92 with an enlarged end 94 that fits over the enlarged head 22 of the strap mounting knobs 20, and a reduced end 96 that fits snugly on the shank end 24 of the strap mounting knobs 20.

Figure 5:
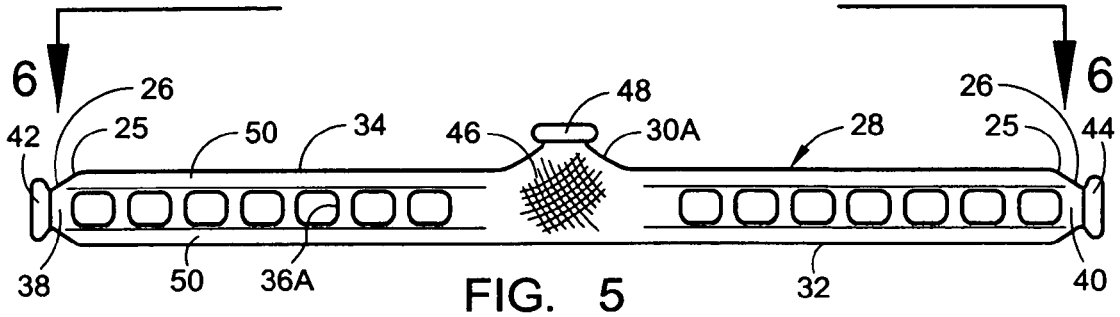
FIG. 5 is a rear elevation view of the dive fin replace heel strap.
Figure 6:
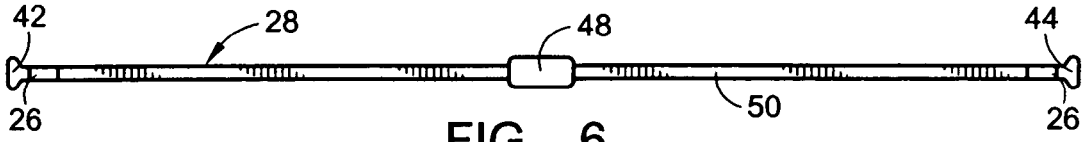
FIG. 6 is a plan view of dive fin replacement heel strap as taken on line 6—6 of FIG. 5.

FIG. 5 is a side view of the preferred embodiment of the universal dive fin replacement heel strap 28 displaying the heel area 30A with the textured surface 46 that retards sliding of the wearers heel. The two side elements 32 and 34 show the plurality of orifices 36A in a rectangular shape and the pull-tabs 42 and 44 on the distal ends 38 and 40 with the outer edges 50 shown in their enlarged state. FIG. 6 is a top view of the universal dive fin replacement heel strap 28.

Figure 7:
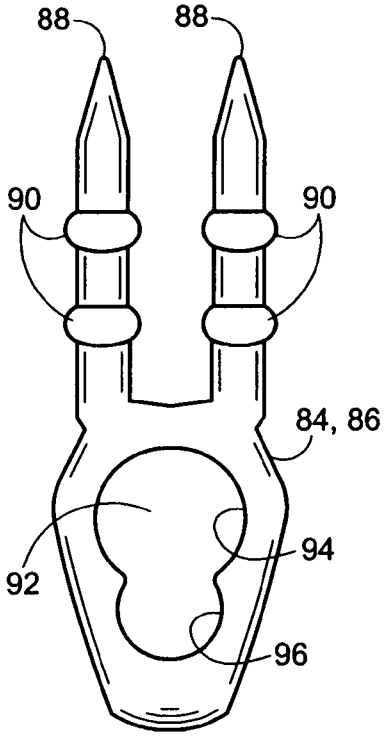
FIG. 7 is the front view of the multiple-tube surgical tubing attachment clips.
Figure 8:
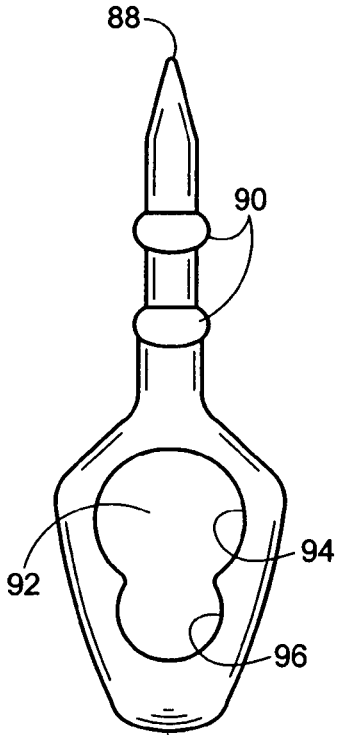
FIG. 8 is the front view of the single-tube surgical tubing attachment clips.
Figure 9:
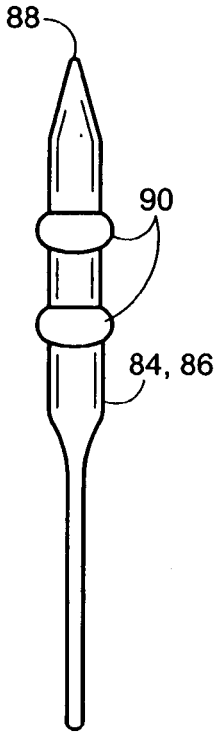
FIG. 9 is a side view of the surgical tubing attachment clips of FIGS. 7 and 8.

FIG. 7 depicts the attachment clips 84 and 86 with two prong ends 88 with FIG. 8 depicting one prong end 88 [with bumps 90 and combination orifice 92 having an enlarged orifice 94 and smaller orifice 96], but it must be understood that there can be a number of attachment clips 84 and 86 with any number of prong ends 88 [with bumps 90, combination orifice 92 having and enlarged orifice 94 and smaller orifice 96] and still be within the scope of this patent.

Figure 10:
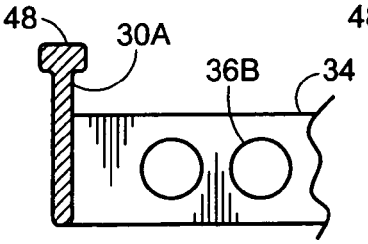
FIG. 10 is a section through the heel portion of the preferred embodiment of the dive fin replacement heel strap.
Figure 11:
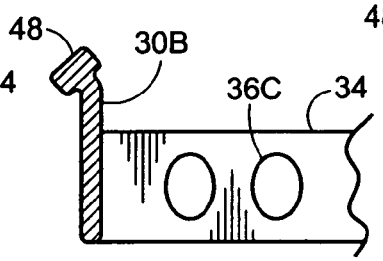
FIG. 11 is a section through the heel portion of an alternate embodiment of the dive fin replacement heel strap with the grip member tipped away from the heel area.
Figure 12:
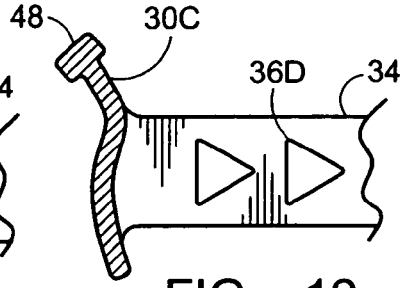
FIG. 12 is a section through the heel portion of an additional alternate embodiment of the dive fin replacement heel strap with in a shape that will conform to the shape of the wearer's heel.

FIG. 10 is a section through the heel portion 30A with the flat configuration and the pull tab 48 straight up and the orifice 36B in a spherical shape while FIG. 11 shows a section through the heel portion 30B with the pull tab 48 angled away from the wearers heel and the orifice 36C in a elliptical shape. FIG. 12 is a section showing the heel portion 30C in the curved shape matching the shape of the heel of the wearer with the pull tab 48 and the orifice in a triangular shape 36D.

Figure 13:
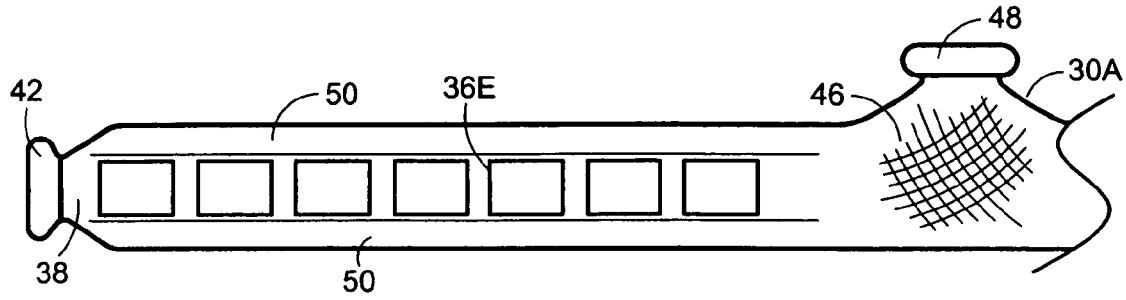
FIG. 13 is a side view of the left side of the universal replacement dive fin strap displaying a single square orifice with the enlarged edge.
Figure 14:
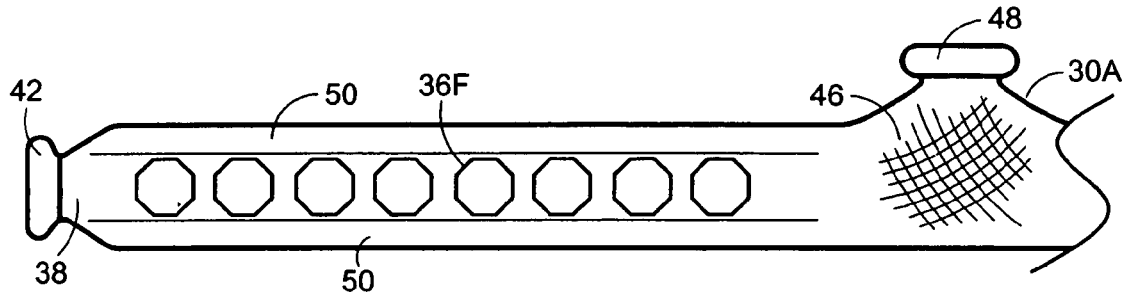
FIG. 14 is a side view of the left side of the universal replacement dive fin strap displaying two octagonal orifices with the enlarged edge.
Figure 15:
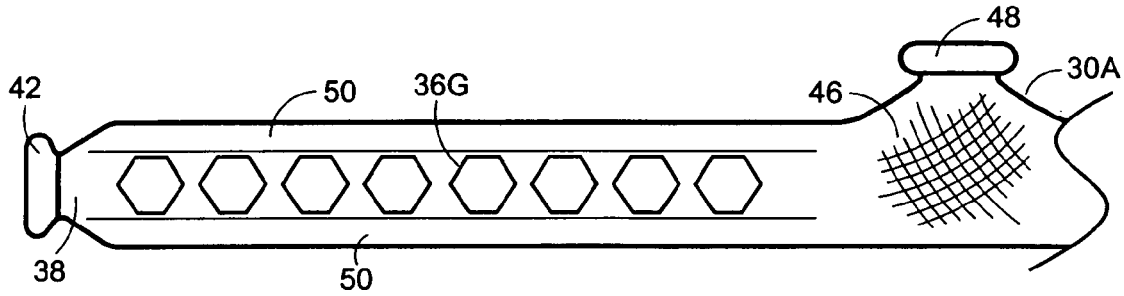
FIG. 15 is a side view of the left side of the universal replacement dive fin strap displaying three hexagonal orifices with the enlarged edge.
Figure 16:
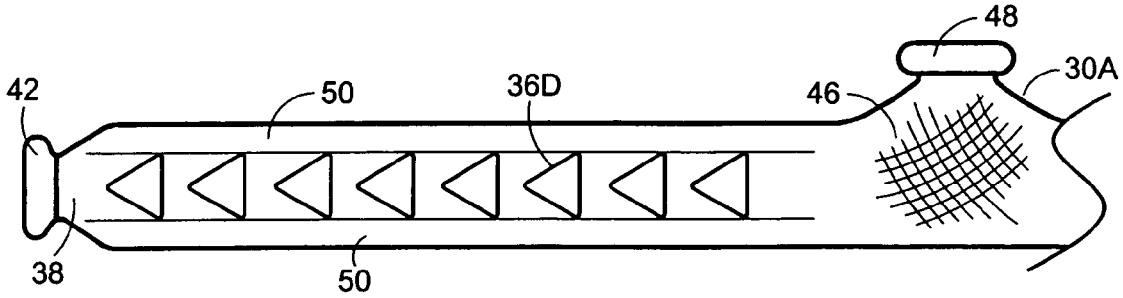
FIG. 16 is a side view of the left side of the universal replacement dive fin strap displaying four elongated narrow orifices without the enlarged edge.

FIGS. 13 through 16 display the left side of the universal replacement dive fin strap with four of the different configurations of orifices, the first being FIG. 13, showing the square orifice 36E, located in the distal end of the strap 38 next to the pull tab 42. The second FIG. 14 having two octagonal orifices 36F, located in the distal end of the strap 38 next to the pull tab 42. The third being FIG. 15, showing the hexagonal orifices 36G, located in the distal end of the strap 38 next to the pull tab 42. The fourth FIG. 16 being four elongated narrow orifices 36H, located in the distal end of the strap 38 next to the pull tab 42 without the enlarged edge.

Figure 17:
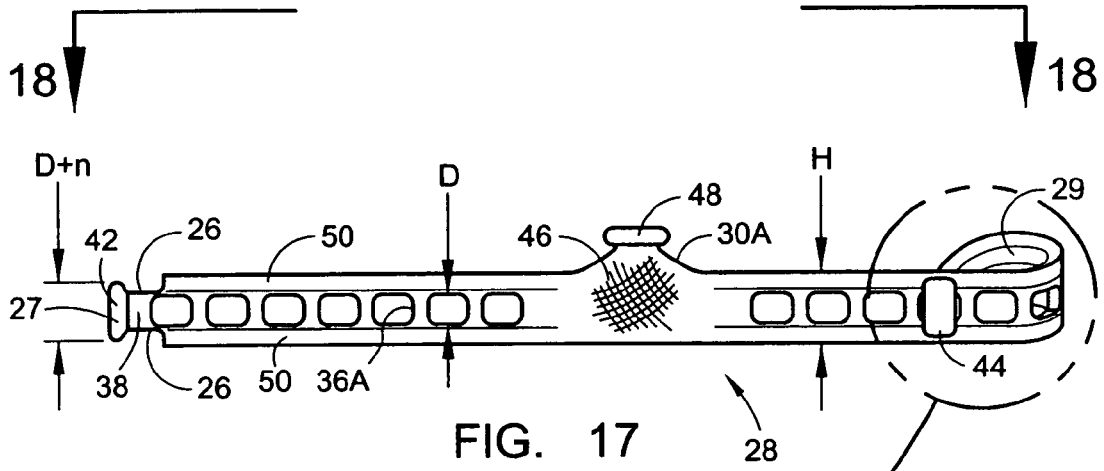
FIG. 17 is a rear elevation view of the dive fin replacement heel strap with a tab-lip structure attached to a buckle of a fin and passed through an orifice on the strap.

FIG. 17 illustrates the strap 28 engaging a dive fin 110 having an open pocket 14 and a buckle 122. The strap [not shown] manufactured for this fin 110 threads through the buckle 122 and into and through translating buckles on the strap. This permits adjustment for size and comfort. When the strap becomes unusable for whatever reason, it must be discarded and typically a new strap of similar design replaces the old one. For a diver, on a dive, this can be a cumbersome and, oftentimes, dangerous experience; particularly if the diver does not have a similar replacement strap.

The present invention is suitable to serve as a replacement strap for the buckle strap and buckle fin 110. The unique distal-end structure of the tab 42, 44 and lip 27 in conjunction with the indent 26 created by the diagonal design 25 and the orifices 36A–H enable this unexpected result. Since the distal ends 38, 40 of the strap 28 and their respective tabs 42, 44 are virtually identical in structure, for administrative clarity when the term "distal end" is used, regardless of the reference character employed, it shall be deemed to refer to and incorporate the other end [i.e., 38, 40 interchangeable unless otherwise indicated]; and when the term "tab" is used, regardless of the reference character employed, it shall be deemed to refer to and incorporate the other tab as well [i.e., 42, 44 interchangeable unless otherwise indicated]. For illustration purposes, tab 44 is shown as the end being employed to attach the strap 28 to the fin 110 and tab 42 is shown as the tab revealing the unique structural features of the tabs.

At the end 38 of the strap 28 adjacent to the tab 42 is an indent 26 on the bottom and on the top of the outer edges 50. The indent may be defined by either:

(1) a downward angling diagonally from the top toward the tab 42 and upward diagonally from the bottom toward the tab 42 [as illustrated in FIG. 5] at angles of approximately between 15° and 60° from the horizontal plane of the respective outer edges, resembling a V-like structure, up to approximately 89°]. The diagonal narrowing is represented by reference character 25 and is hereby referred to as diagonal narrowing [the cut-out or indent 26 formed by the diagonal narrowing 25 terminates at the tab 42]; or (2) an approximately perpendicular cut-out downward from the top outer edge 50 and upward from the bottom outer edge, in relation to the horizontal plane of the respective outer edges and a cut-out thereafter toward the tab 42 followed by a respective cut-out toward the outer edges 50, thereby resembling a U-like structure with squared [as illustrated in FIG. 17] or curved corners.

The distance from the upper indent to the lower indent is approximately equal to or less than the dimension of the opening of the orifices 36A. Where the dimension of the opening of the orifice 36A is D, then the distance from upper indent to lower indent is D to D−n [where 'n' is any distance]. The tab 42 is adjacent to and distal from the indent 26 and it extends vertically above and below the respective indents. Where the height of the strap is H, the height of the tab 42 is D+n and generally H−n, though it could be H.

The width of the tab 42 also is greater than the width of the strap 28. Where the width of the strap 28 is W, then the width of the tab 42 is W+n. For the locking feature, however, the width of the tab 42 generally should be substantially greater than the width of the strap such as from approximately 1.5 W to approximately 10 W. The height of the tab 42 being generally greater than the dimension of the opening of the orifice 36A and the width of the tab 42 being greater than the width of the strap 28 is referred to as the tab-lip structure with the lip-portion bearing reference character 27.

Figure 19:
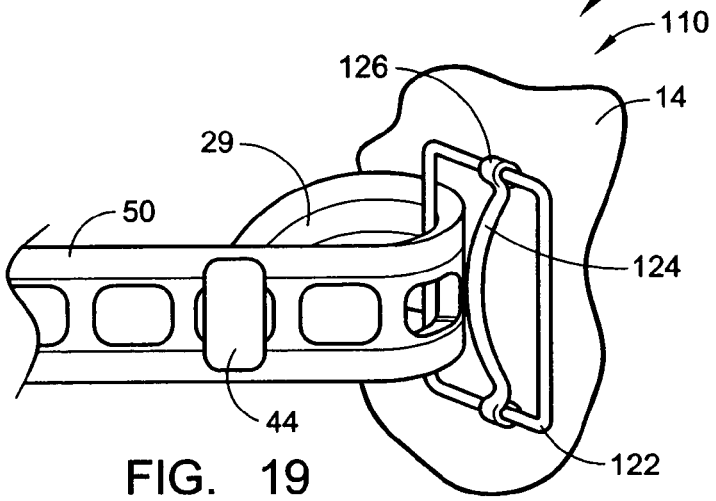
FIG. 19 is a detailed close-up view of the "locking" feature.

It is this tab-lip 42, 27 structure which, after the tab 42 is passed through an orifice 36A which "locks" the tab 42 in place and prevents the tab 42 from retreating from the orifice 36A. It is the structure of the indents 26 and their location [adjacent to the tab 42] which facilitates passage through the orifices 36A and it is the structure of the tab 42, in relation to the orifice 36A, which "locks" the end of the strap thereat. FIG. 19 illustrates this locking in close-up detail.

Therefore, either tab 42, 44 of the present invention 28 may be pushed through the opening 124 in the buckle 122 of the fin 110 [in FIGS. 17 and 19 tab 44 is illustrated as the operative tab], and then the tab 44 is passed back toward the strap 28 and pressed through any suitable orifice 36A. The loop 29 formed encircles the buckle's stem and holds it. The indent 26 [V-shaped or U-shaped] eases the passage of the strap's distal end through the orifice and the lip 27 around the tab 42 edges "locks" the end thereat. This type of buckle 122 may also have a vertically-disposed horizontally-sliding bar 126.

Figure 18:
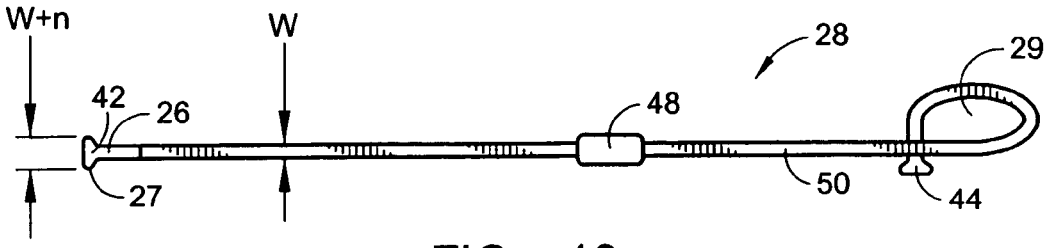
FIG. 18 is a plan view of dive fin replacement heel strap as taken on line 17—17 of FIG. 17 with the tab-lip structure passed through an orifice without the fin illustrated.

FIG. 17 in combination with FIG. 19 illustrates the strap 28 so attached to the previously strapless dive fin 110. FIG. 18 illustrates this attachment [without the dive fin 110] as viewed from above.

It must be made clear that any number, any geometric sizes or shapes of these orifices, for the means of attachment, may be located along any portion of either side of the universal replacement dive fin strap, and the strap may or may not have the same orifices symmetrically located on either side of the strap and still be within the scope of this patent.

I claim:

1. A dive fin replacement heel strap for use on open-foot pocket dive fins having a mounting device on each side of said fin, said heel strap adapted to secure said fins onto a user's foot, said heel strap comprising:

(a) an elongate elastic material, of a predetermined width (W) having a first end, a second end, a center section, and a height defined by an upper horizontal surface and a lower horizontal surface;

(b) a plurality of orifices, of a predetermined opening size (D), positioned from said first end toward said center section and positioned from said second end toward said center section, said plurality of orifices formed into said elongate elastic material and adapted to attach to said mounting device;

(c) a tab on either said first end or on said second end or on each respective end of said elongate elastic material, said tab having a solid flexible lip around the periphery of said tab forming a tab-lip having a width greater than W and a height greater than D; and (d) an indent in the upper horizontal surface and in the lower horizontal surface of said elongate elastic material adjacent to said tab-lip.

2. The heel strap of claim 1 wherein said plurality of orifices comprise any geometric shape selected from a group consisting of square, rectangular, round, spherical, elliptical, triangular, and polygonal.

3. The heel strap of claim 1 further comprising an upward extension approximate to said center section, said upward extension adapted to be grasped by the user to aid the user in donning and removing the fin.

4. The heel strap of claim 3 wherein said upward extension is angled away from said elongate elastic material.

5. The heel strap of claim 3 wherein said upward extension further comprises an orifice cut therethrough.

6. The heel strap of claim 3 further comprising a pull member on said upward extension, said pull member protruding outward and inward approximately perpendicularly to said upward extension.

7. The heel strap of claim 1 wherein said orifices are adapted to secure onto said mounting device whereby placement of orifices proximal to said center section over said mounting device accommodates a smaller foot or a tighter fit and placement of orifices distal from said center section over said mounting device accommodates a larger foot or a looser fit.

8. The heel strap of claim 1 wherein said tab-lip is adapted to pass through said mounting device and further adapted to pass through and lock into one of said plurality of orifices, whereby placement of said tab-lip into orifices proximal to said center section accommodates a smaller foot or a tighter fit and placement of said tab-lip into orifices distal from said center section over said mounting device accommodates a larger foot or a looser fit.

9. A dive fin replacement heel strap for use on open-foot pocket dive fins having a mounting knob on each side of said dive fin, said heel strap adapted to secure said dive fins to a user's foot, and comprising:

(a) an elongate bungee element with opposed ends in the form of end loops, said end loops adapted to secure said heel strap to each mounting knob;

(b) a strap loop on said bungee element between said end loops; and (c) a tensioning device adjacent to said strap loop wherein movement on said tensioning device along said bungee element adjusts the length of said heel strap.

10. The heel strap of claim 9 wherein said strap loop is approximately centrally disposed on said bungee element.

11. A dive fin replacement heel strap for use on open-foot pocket dive fins having a mounting knob of each side of said dive fin, said heel strap adapted to secure said dive fins to a user's foot, and comprising:

(a) at least one elongate elastic tube member having opposed ends, each of said opposed ends having an opening thereat; and (b) an attachment clip disposed at each respective end of said opposed ends and insertable into said opening of said opposed ends, said attachment clips adapted to secure said heel strap to each mounting knob.

12. The heel strap of claim 11 wherein said attachment clips comprise one or more prongs adapted to insert into one or more said opening of said opposed ends.

* * * * *